United States Patent [19]

Leginus et al.

[11] Patent Number: 4,935,980

[45] Date of Patent: Jun. 26, 1990

[54] DEVICE FOR SELECTIVELY CLEANING DEBRIS FROM A LIQUID POOL

[76] Inventors: Alexander Leginus, 8154 Sterling Dr., El Cajon, Calif. 92021; Marvin A. Taylor, 2445 Amity St., San Diego, Calif. 92109

[21] Appl. No.: 367,887

[22] Filed: Jun. 19, 1989

[51] Int. Cl.[5] ..... E04H 3/20

[52] U.S. Cl. ..... 15/1.7; 210/169

[58] Field of Search ..... 15/1.7, 344; 210/169

[56] References Cited

U.S. PATENT DOCUMENTS 3,258,801 7/1966 Campbell ..... 15/1.7

4,896,392 1/1990 Hull et al. ..... 15/1.7

*Primary Examiner*—Edward L. Roberts

*Attorney, Agent, or Firm*—George J. Rubens

[57] ABSTRACT

A device is provided for selectively cleaning debris from the bottom of a liquid pool. The device has a chamber having a water intake tube having an inlet end and extends through the lower end of the chamber and terminates in an outlet end which has a one-way valve mounted thereon. The lower end of the chamber has an opening for dumping water from the chamber. A valve is provided for blocking the opening by the water pressure of the pool and a filter is provided for filtering debris from the water before being dumped through the opening. An ambient air intake tube is connected to the upper end of the chamber and has an opening whereby ambient air can be trapped in the chamber by the operator.

15 Claims, 1 Drawing Sheet

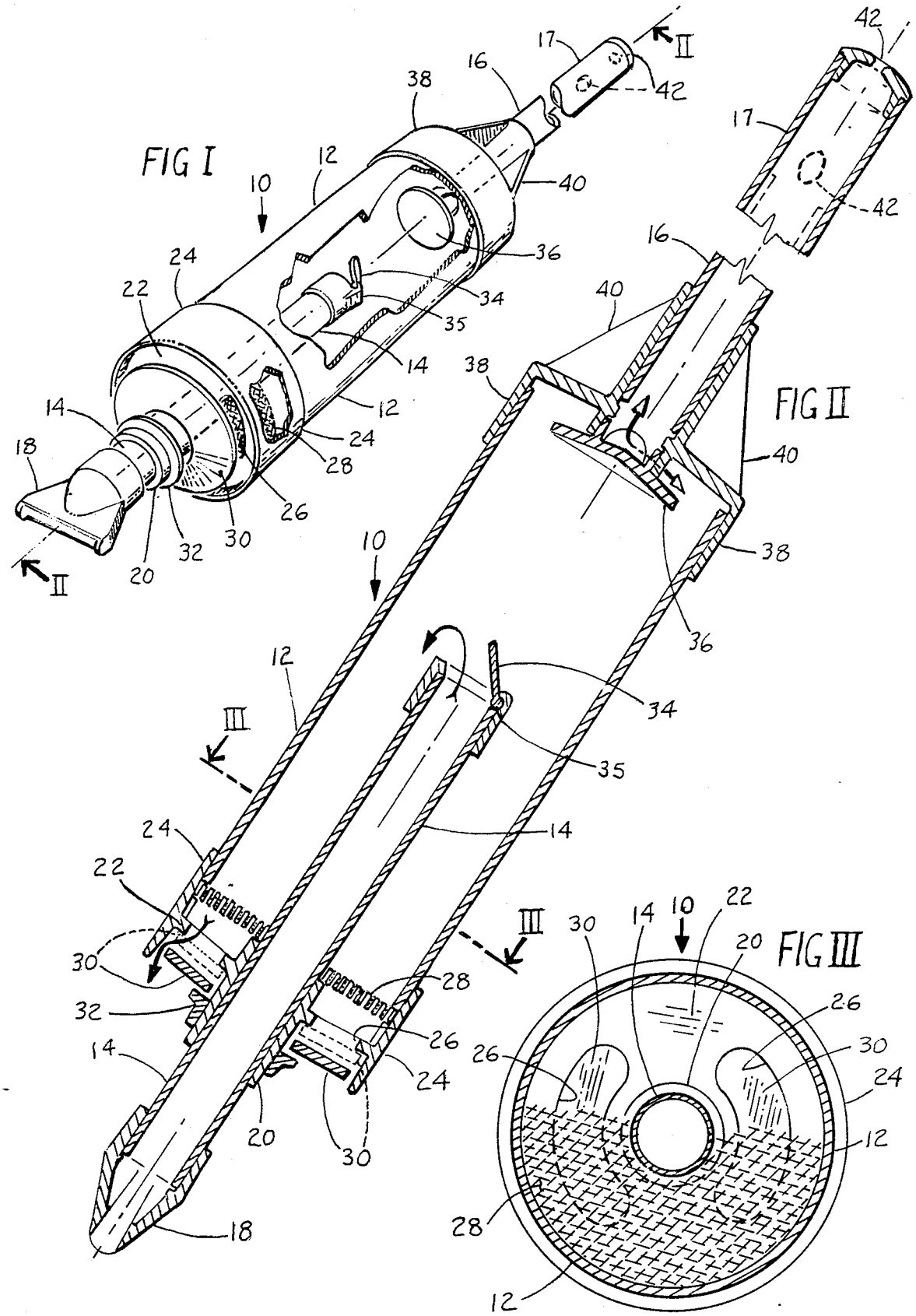
FIG I
FIG II
FIG III
10
12
14
16
17
18
20
22
24
26
28
30
32
34
35
36
38
40
42
II
III

DEVICE FOR SELECTIVELY CLEANING DEBRIS FROM A LIQUID POOL

BACKGROUND OF THE INVENTION

This invention pertains to cleaning devices, and more particullary to such a device for selectively removing debris usually from the bottom of a liquid pool, such as swimming pools, spas and the like, without the need for the use of electrical pumps requiring long vacuum hoses, or the use of hand pumps.

There is a need for removing selectively debris from the bottom of pools, such as sand, gravel, small leaves, coins etc. from the bottom of such pools that may scratch or stain the smooth bottom surfaces.

The conventional swimming pool cleaning devices consist of an electrical pump connected to a wide brush head through a long vacuum hose which device is used periodically to sweep the entire surface of the pool of dirt and other particles of debris. Although such equipment is necessary to periodically sweep the entire pool surface, it is cumbersome and time consuming to assemble such equipment for removing selected pieces of debris between the regular pool sweeping operations. In addition this conventional sweeping equipment has a limited ability to remove coins and other relatively heavier debris.

The above described limitations in conventional pool sweeping devices have been recognized in the prior art, such as by U.S. Pat. Nos. 3,820,182, 4,094,031, and 4,584,733.

All of these prior art patents rely on hand operated pumps to create a sufficient vacuum to suck up the small size debris not convenient or possible by the conventional pool sweeping equipment. However, there are also limitations in the use of manually operated pumps for selectively removing small pieces of debris in the inability to create sufficient suction to do the job, especially when the hand pump is operated by a woman or child, and also at deeper ends of the pool being cleaned. In addition, the amount of debris laden water that can be collected is limited to the volume of the collecting chamber, and the amount of suction that can be physically exerted by the operator with one hand, especially while attempting to direct the device to the specific debris to be collected. Finally, in the prior art hand pumps, sand and other gritty debris can restrict the movement of the pump piston and score the piston chamber, all of which affects the ability of the operator to create the necessary suction to do the task.

The present invention device eliminates the need for electrical vacuum pumps and long depending hose, as well as the need for manually operated hand pumps to create a sufficient suction to selectively pick up the usual debris found on the bottom of pools. This unique result is achieved by utilizing the difference in pressure between ambient air pressure and the liquid pressure existing on the bottom of the pool, and by the operator controlling the alternate blocking and venting the ambient air in the water collecting chamber to allow the water and debris to be sucked into the chamber for subsequent dumping to strain out the debris for disposal. Because the cleaning device is manuevered around the bottom of the pool and lifted from the pool with the water and debris, it is important that the device be simple and of a light weight construction.

SUMMARY OF THE INVENTION

It is an object of the present invention to provide a cleaning device for liquid pools, such as swimming pools, spas, and other liquid containers, that can selectively remove small pieces of debris, such as pebbles, small leaves, dirt, coins and the like without the need for any electrical, mechanical, or manual pumping effort to produce the required suction to pick up the selected debris along with a portion of the liquid.

According to the present invention, the necessary suction, or negative pressure, is available by utilizing the difference in pressure between ambient air pressure and the liquid pressure existing at the bottom of the pool, and by the operator controlling the volume of ambient air trapped in the debris laden water collected in the device chamber.

The novel cleaning device comprises generally a water collecting chamber collected at its lower end to a water intake tube having a nozzle end adapted to be positioned by the operator adjacent the debris to be removed from the pool bottom. An upper end of the chamber is connected to an ambient air intake tube which also functions as the handle for the device. The air intake tube has an air inlet opening at the handle end to ambient air, which opening can be closed or opened by a hand of the operator depending on which phase of the cleaning operation is involved. Suitable valve means are provided to control the flow of water in and out of the chamber. Suitable check valves can be provided, one preventing reverse water flow through a filter/-strainer, and one to prevent incidental back flow down the water intake tube.

BRIEF DESCRIPTION OF THE DRAWINGS

FIG. 1 is a perspective view of the novel pool cleaning device with the water collecting chamber partially broken away to show the reverse flow check valve and deflector plate.

FIG. 2 is a longitudinal section view taken along line II—II of FIG. 1.

FIG. 3 is a cross section view taken along line III—III of FIG. 1.

DETAILED DESCRIPTION OF THE INVENTION

Referring to the drawings where like reference numerals refer to similar parts throughout the figures, there is shown in FIG. 1 a perspective view of the novel cleaning device 10 for selectively removing various kinds of debris from the bottom of a liquid pool, such as spas, swimming pools, and the like. Device 10 comprises an enlarged air/water collecting tubular chamber 12 having connected at its normally lower end to a water and debris intake tube 14, and at its normally upper end to an ambient air intake tube 16. Tube 16 is elongated to form an upper handle portion 17 which can be telescopic in construction slidably to adjust to varying depths of the pool bottom to be cleaned.

Water intake tube 14 may terminate at its lower end with a nozzle 18 which may be detachably mounted to tube 14 to accommodate nozzles of different configurations depending on the size of the debris to be removed from the pool bottom. Water intake tube 14 is supported intermediately by a ferrule 20 to a portion of a end wall 22 of a lower end chamber cap 24 which is removably mounted from chamber 12 for disposing the debris collected therein. End wall 22 of cap 24 is provided with a pluraity of openings 26 through which water collected in chamber 12 can be dumped back into the pool after the debris is screened out, in a manner later to be described. A removable screen or filter 28 is nested inside cap 24 adjacent end wall 22 to filter out the debris from the debris laden water collected in chamber as the water is being dumped through openings 26. Screen or filter 28 can be made of different shapes and size openings, of various non-corrosive materials depending on the debris to be removed from the pool bottom.

A dump valve 30, having a dish-shaped disc configuration generally conforming to the inside of cap 24, is slidably mounted on ferrule 20 within cap 24 between end wall 22 and a retainer ferrule 32 secured to ferrule 20. Valve 30 functions to block openings 26 on the outside of end wall 22, as shown in broken lines in FIG. 2, under water pressure when the device is immersed into the pool during its debris collecting phase. This action forces the water and selected debris through nozzle 18 and water intake tube 14 into chamber to be collected.

When the cleaning is removed from the pool or close to the pools surface by the operator, the weight of the debris laden water in chamber 12 forces dump valve 30 against retainer 32, as shown in solid lines in FIG. 2, to uncover openings 26 in end wall 22 and enable the water in the chamber to be dumped while retaining the debris on screen 28.

The end of water intake tube 14 extends into chamber 12 beyond cap 24, and is provided with a flow check valve 34 hinged to the tube at 35. Check valve 34 functions as a one-way valve to allow debris laden water to enter chamber 12, and prevents its reverse flow down the intake tube 14 back into the pool, such as when the device is lifted in the pool during the dumping phase. A deflector plate 36 is mounted to an upper chamber cap 38 within the upper end of chamber 12 and above check valve 34 and spaced from the end of air inlet tube 16 where it enters chamber 12. Deflector plate 36 prevents debris laden water from entering and blocking the end of air inlet tube 16 and the venting of air from chamber 12.

Air intake tube 16 is supported to upper chamber cap 38 by reinforcing ribs 40 to prevent breakage at this stress area as tube 16 functions as handle 17 during the cleaning phase when the chamber 12 if forced down into the pools and moved along its bottom surface. The upper end of air intake tube 16 at handle 17 is provided with an air inlet opening 42, which opening can be located at the end of handle 17 to be blocked and unblocked by a thumb of the operator, or along the side of handle 17, as shown in broken lines in FIG. 2, to be controlled by the hand, depending on how the handle is gripped by the operator.

Air opening 42 enables the operator to trap ambient air in chamber by blocking opening 42 with his hand prior to immersing the chamber into the pool, and thereafter metering the venting of air from the chamber by water pressure during the debris collecting phase. Continuous or intermittent suction at nozzle can be accomplished by the operator in the extent of restricting the amount of air being vented from chamber 12 out of air opening 42, which in turn depends on the manner of cleaning the debris.

The operation of the novel cleaning device may best be described with reference to FIGS. 1 and 2. When the operator desires to begin the debis cleaning operation, the operator grips the end of handle 17 with the device out of the pool and blocks air opening 42 with one hand to trap ambient air inside chamber 12. With air inlet 42 blocked, the operator then immerses chamber 12 into the pool with nozzle 18 positioned next to the debris on the bottom of the pool to be removed. The operator then momentarily, or continuously, unblocks air inlet 42 depending on the extent of cleaning required at any particular time. Unblocking air inlet 42 vents a proportional volume of air in chamber 12, allowing water pressure at the bottom of the pool to suck up the debris along with the water through water inlet tube 14 into chamber 12, displacing the equivalent volume of air being vented through handle 17 and air opening 42. The volume of air being vented from chamber 12 bythe operator controls the amount of water and debris being sucked into chamber 12, as well as the water pressure at the bottom of the pool. That is, the pressure of the ambient air trapped in chamber 12 increases according to the depth of water in the pool, and therefore the flow rate of the debris laden water sucked into chamber 12 increases as the operator vents the compressed air out of inlet 42. Tests have shown that the novel cleaning device will operate satisfactorily in depths of water as little as 12 inches.

During the debris collecting phase, dump valve 30 is pressed by water pressure at the bottom of the pool against end wall 22 (shown in broken lines in FIG. 2) to block openings 26, forcing the debris laden water into chamber 12 through water intake tube 14 past check valve 34. The volume of water and debris sucked into the chamber can be continuous or intermittent depending on the location of the pieces of debris and the selective venting of chamber 12 by the operator's control of air inlet 42 until the chamber is filled with the debris laden water at which time all of the air is vented from the chamber and replaced by the water.

When chamber 12 is completely filled with the debris laden water, a condition the operator can readily sense by the absence of air being expelled from air inlet 42, the operator can then conduct the dumping phase. Dumping the water in chamber 12 is accomplished by the operator lifting the chamber near the water surface, and if air inlet 42 is not blocked by the operator, the weight of the water in the chamberforces dump valve 30 to slide on ferrule 20 against retainer 32 and away from openings 26, as shown in solid lines in FIG. 2. The debris in the chamber water is removed by filter 28 as the water is drained back to the pool. During the dumping phase, flow check valve 34 prevents the debris laden water in the chamber to return to the pool back through water intake tube 14 and avoid the filtering of the debris. The inside of chamber 12 and filter 28 can be readily cleaned, or the later replaced, by removing lower chamber cap 24 from chamber body 12.

It should be noted that chamber can be dumped as described above at any time during the cleaning phase, and not only when the chamber is completely filled with debris laden water.

The novel pool cleaning device functions without the need for electrically operated pumps and depending long flexible vacuum hoses, nor the need for manual efforts to operate the pistons found in hand operated suction devices. Accordingly, the present device can be made of a simple and inexpensive construction, with a minimum of moving parts, and easy to operate by children as well as adults. The present cleaning device can be lighter in weight, an important consideration in hand held equipment, than prior art hand operated pumps in that the suction is obtained soley by a difference in pressure between the water on the bottom of the pool and the ambient air. This enables handle to be telescopic in construction to readily clean debris form the pool bottom at various depths, which construction would be difficult with a piston and rod type hand pump. The components of the present device can be made of a suitable non-corrosive, durable material, such as plastic, which will minimize its weight which is desirable in hand a hand held and manuevered device, and which will reduce manufacturing costs.

We claim:

1. A device for selectively cleaning debris usually found on the bottom of liquid pools, comprising:
   a chamber having upper and lower ends;
   a liquid intake tube having an inlet end adapted to be positioned adjacent the debris to be removed, said tube mounted to and extending through the lower end of said chamber and terminating in a liquid outlet therein;
   said chamber having means for dumping liquid and retaining the debris collected therein;
   said chamber having valve means automatically blocking the dumping means when the chamber is immersed in the pool;
   means for positioning the device along the bottom of the pool with the liquid intake inlet adjacent the debris to be removed;
   an ambient air intake tube having a lower end mounted to and extending into the upper end of the chamber;
   whereby ambient air can be trapped in the chamber by an operator blocking said air intake tube prior to immersing the chamber into the pool, and when the chamber is immersed into the pool with the liquid intake tube positioned adjacent the selected debris is to be removed, venting the ambient air in the chamber by the operator unblocking the air intake tube causes the liquid under a greater pressure than the air in the chamber to displace the portion of air vented with the liquid then carrying along the selected debris into the chamber.

2. The device of claim 1 wherein said air intake tube has a handle portion and is the means for positioning the device.

3. The device of claim 2 wherein the handle has an air opening whereby ambient air in the air intake tube can be blocked and unblocked by the operator.

4. The device of claim 3 wherein the air opening in the handle is at the end of the air intake tube.

5. The device of claim 3 wherein the air opening in the handle is located adjacent the end of the handle to be controlled by the hand of the operator.

6. The device of claim 2 wherein said air intake handle is telescopic in construction.

7. The device of claim 1 wherein means are provided in the chamber for filtering out the debris from the liquid when the liquid in the chamber is dumped.

8. The device of claim 1, wherein the liquid outlet within the chamber is provided with a one-way valve to prevent debris laden liquid in the chamber flowing back into the pool back through the liquid intake tube, 9. The device of claim 1 wherein said means for dumping the debris laden liquid in the pool is operated by controlling the venting of the air in the chamber.

10. The device of claim 1 wherein said dumping means is a member freely movable on the liquid intake tube capable of blocking and unblocking an opening in the chamber.

11. The device of claim 1 wherein a deflector member is mounted in the chamber above said liquid outlet to prevent the debris laden liquid from blocking the air intake tube.

12. A cleaning device for selectively removing debris from a swimming pool containg water, comprising:
   a chamber having an upper and lower ends,
   a water intake tube having an inlet end and extending through the lower end of the chamber terminating in an outlet end therein,
   a one-way valve mounted on the outlet of the water intake tube for preventing water accummulated in the chamber from returning back into the pool through the water intake tube,
   the lower end of said chamber having an opening extending therethrough for dumping debris laden water accummulated in the chamber,
   valve means for blocking said chamber opening by the pressure of the water in the pool,
   means in said chamber for filtering the debris from the water before being dumped through the chamber opening,
   the upper end of the chamber being connected to a lower end of an ambient air intake tube, said air intake tube functioning as a handle for positioning the chamber along the bottom of the pool adjacent the debris to be removed,
   an upper end of the air intake tube having an opening whereby ambient air can be trapped by the operator in the chamber, and vented by the operator depending on whether the device is in the cleaning phase or the dumping phase,
   whereby ambient air can be trapped in the chamber by the operator blocking the opening in the air intake tube, and when the chamber is immersed into the water and positioned adjacent the debris to be removed, the operator can vent a predetermined volume of air in the chamber by unblocking said air intake opening causing the debris and water under pressure to be sucked into the chamber through said water intake tube replacing the volume of air vented from the chamber, and when the operator lifts said device from the water, the weight of the debris laden water in the chamber moves the blocking valve to uncoved the chamber opening dumping the water in the chamber back into the pool with the debris retained in the chamber by the filter means.

13. The cleaning device of claim 12 wherein a one-way valve is mounted on the water outlet end to prevent debris lade water entering the chamber from returning back to the pool through said water intake tube.

14. The cleaning device of claim 13 wherein said valve means for blocking the chamber opening is a member slidably mounted on the water intake tube.

15. The cleaning device of claim 14 whereinall of the components except the handle are made of a plastic material.

* * * * *